United States Patent [19]

Martin et al.

[11] 4,318,521

[45] Mar. 9, 1982

[54] LAWN REFUSE BAG POSITIONER

[76] Inventors: Emma L. Martin; John G. Martin, both of 9847 Estate La., Dallas, Tex. 75238

[21] Appl. No.: 60,784

[22] Filed: Jul. 25, 1979

[51] Int. Cl.[3] ..... B65B 67/12

[52] U.S. Cl. ..... 248/99; 15/257.1; 248/95; 248/100; 248/156

[58] Field of Search ..... 248/95, 99, 101, 98, 248/100, 156; 135/15 PE; 294/1 R, 55; 15/257.1, 257.4, 257.8, 257.7

[56] References Cited

U.S. PATENT DOCUMENTS

| | | | |
|---|---|---|---|
| 3,135,984 | 6/1964 | Henke | 15/257.1 |
| 3,697,030 | 10/1972 | Schultz | 15/257.1 |
| 3,934,803 | 1/1976 | Paulus, Jr. | 248/99 |
| 3,998,415 | 12/1976 | D'Antionio et al. | 15/257.1 |
| 4,023,842 | 5/1977 | Harvey | 248/99 X |
| 4,063,567 | 12/1977 | Martin et al. | 135/15 PE |

FOREIGN PATENT DOCUMENTS

| | | | |
|---|---|---|---|
| 925493 | 5/1973 | Canada | 15/257.1 |
| 1355611 | 6/1974 | United Kingdom | 248/99 |

*Primary Examiner*—James T. McCall

*Attorney, Agent, or Firm*—Thomas D. Copeland

[57] ABSTRACT

The specification discloses an especially designed and built bag frame that comprises a closed loop of tubing having a shaped form about which the open end of a refuse bag of plastic or other flexible material may be stretched and wrapped so as to hold the mouth of the bag open while the user rakes or gathers in grass, leaves, or other refuse. In one embodiment the frame is D-shaped so that the flat side may rest squarely on the ground. In another embodiment the frame includes spikes adjacent the flat side so that the frame may forceably be engaged with the earth so that it will stand alone when the user releases hold thereof; this permits the user to have both hands free for the raking or gathering activity.

4 Claims, 13 Drawing Figures

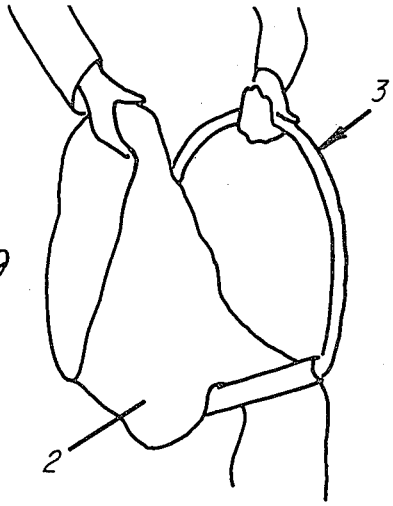
Fig. 9
Fig. 10
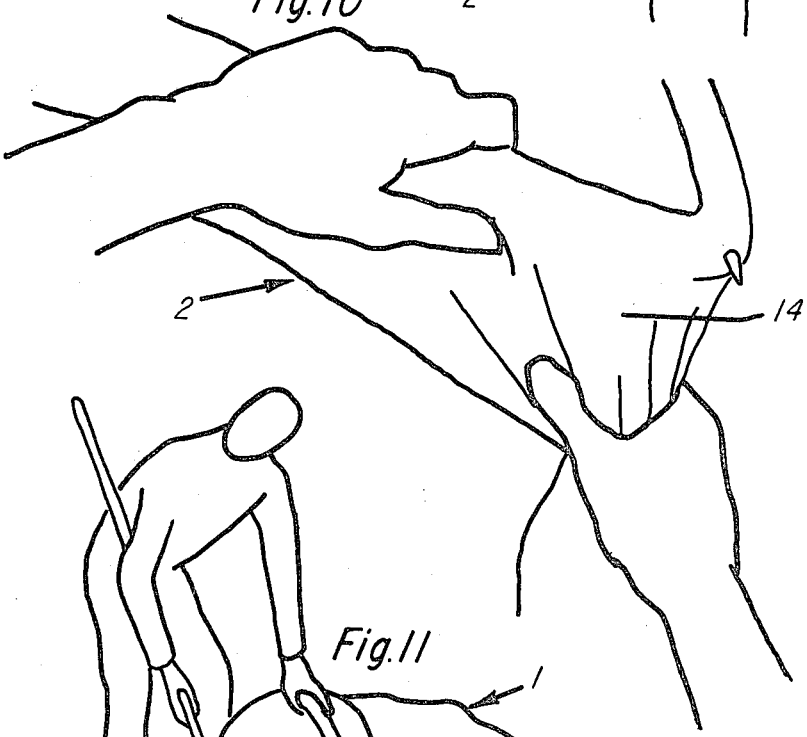
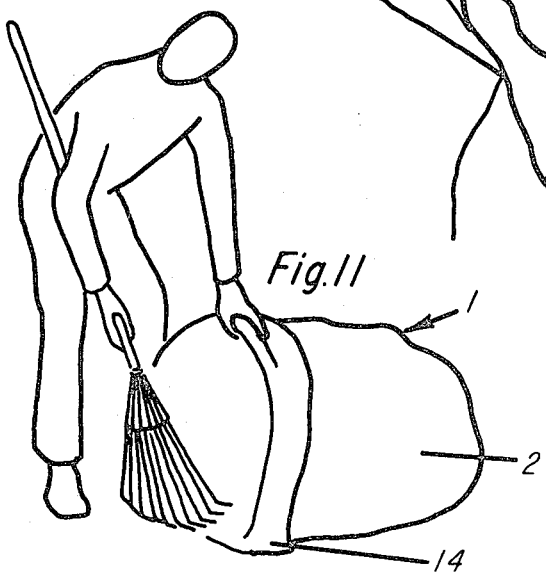
Fig. 11

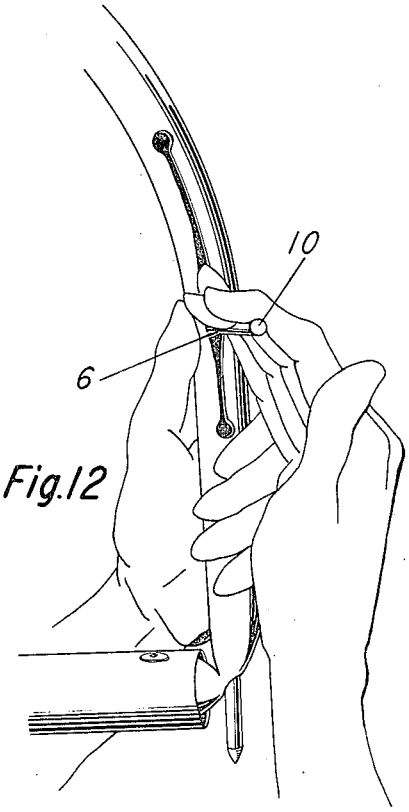
Fig.12
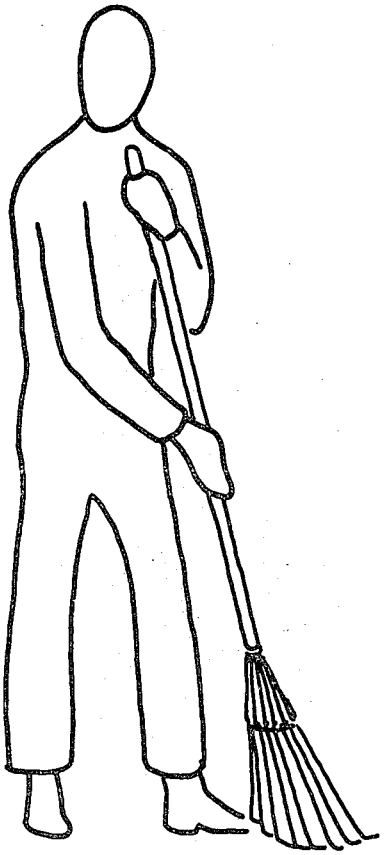
Fig.13
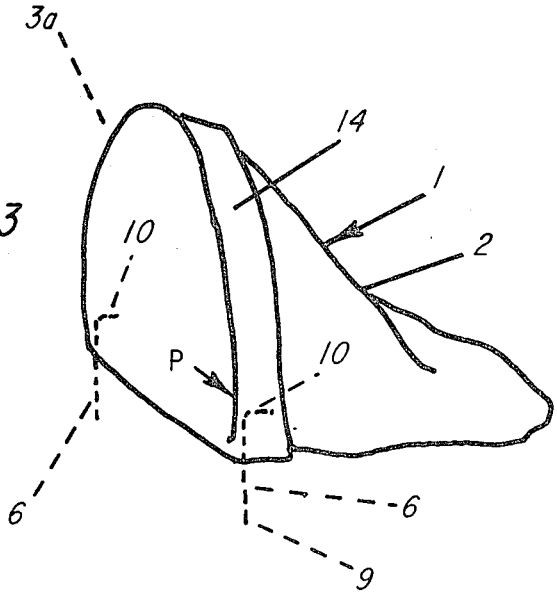

LAWN REFUSE BAG POSITIONER

FIELD OF THE INVENTION

This invention relates generally to refuse handling equipment and more particularly to devices for holding open the mouthes of plastic refuse bags.

THE PRIOR ART

It is known that there has heretofore been devised relatively expensive wheeled carts that are adapted to carry plastic refuse bags in a manner similar to a manually operated golf bag cart, wherein the refuse bag rides in a vertical position and trash and/or leaves, cuttings, etc., are deposited into the bag from above the upwardly facing opening.

SUMMARY OF THE INVENTION

This invention provides a product that is relatively inexpensive when compared to a wheeled cart, and provides a bag opening form that is extremely light weight so that the bag and its opener form may be easily transported by children or anyone able enough to do light yard work, such as raking leaves. For example, when leaves are gathered into a pile on a lawn, the worker simply inserts the generally circular, but specifically D-shaped opener form over the open end of a plastic or other material refuse bag and slightly stretches or otherwise folds the open end of the bag around and over the form until the bag and form function as a unitary piece in use. In one embodiment, the worker lays the bag horizontally on the ground adjacent a pile of leaves, and simply holds with one hand the curved portion of the form with open end of the bag thereon in a vertical position and rakes in leaves with the other hand until the bag is filled, whereupon he removes the form and ties the bag in a conventional manner.

In another embodiment, the bag opener form includes stationary or movable spikes that piece the bag near its open end from the side of the form adjacent the ground so that the form and the attached bag are self-supporting and the worker will then have both hands free to channel leaves or other refuse into the open bag end.

DESCRIPTION OF THE DRAWINGS

FIG. 9 shows the bag being threaded into the center opening of the form of FIGS. 1, 2 or 7.

FIG. 10 shows the bag being pulled taut around one edge of the form.

FIG. 11 shows the bag properly stretched over the form of the first embodiment and in use.

FIG. 12 is an enlarged detail view showing one technique for moving the ground engaging spike from its stowed position to its operating (extended) position.

FIG. 13 shows the bag properly stretched over the form of the second embodiment and in use.

DESCRIPTION OF THE PREFERRED EMBODIMENTS

Figure 1:
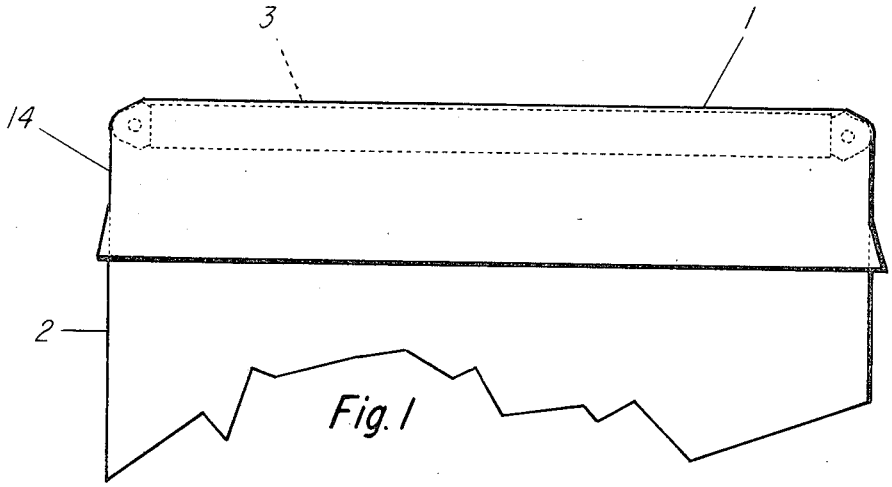
FIG. 1 is a side elevated cutaway view showing the upper side portion adjacent the bag's open top and with one embodiment of the bag opener form installed.
Figure 5:
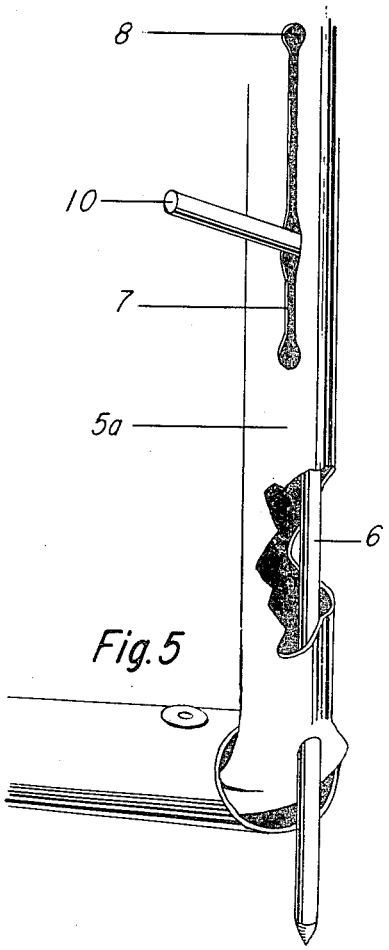
FIG. 5 is an enlarged detail front view of a portion of the second embodiment showing a partial operation of the installed spike.
Figure 2:
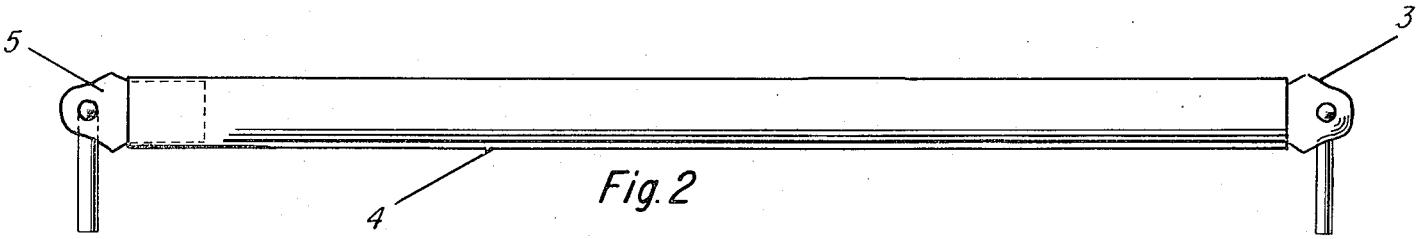
FIG. 2 is a bottom view of the form of FIG. 1 removed from the bag.
Figure 8:
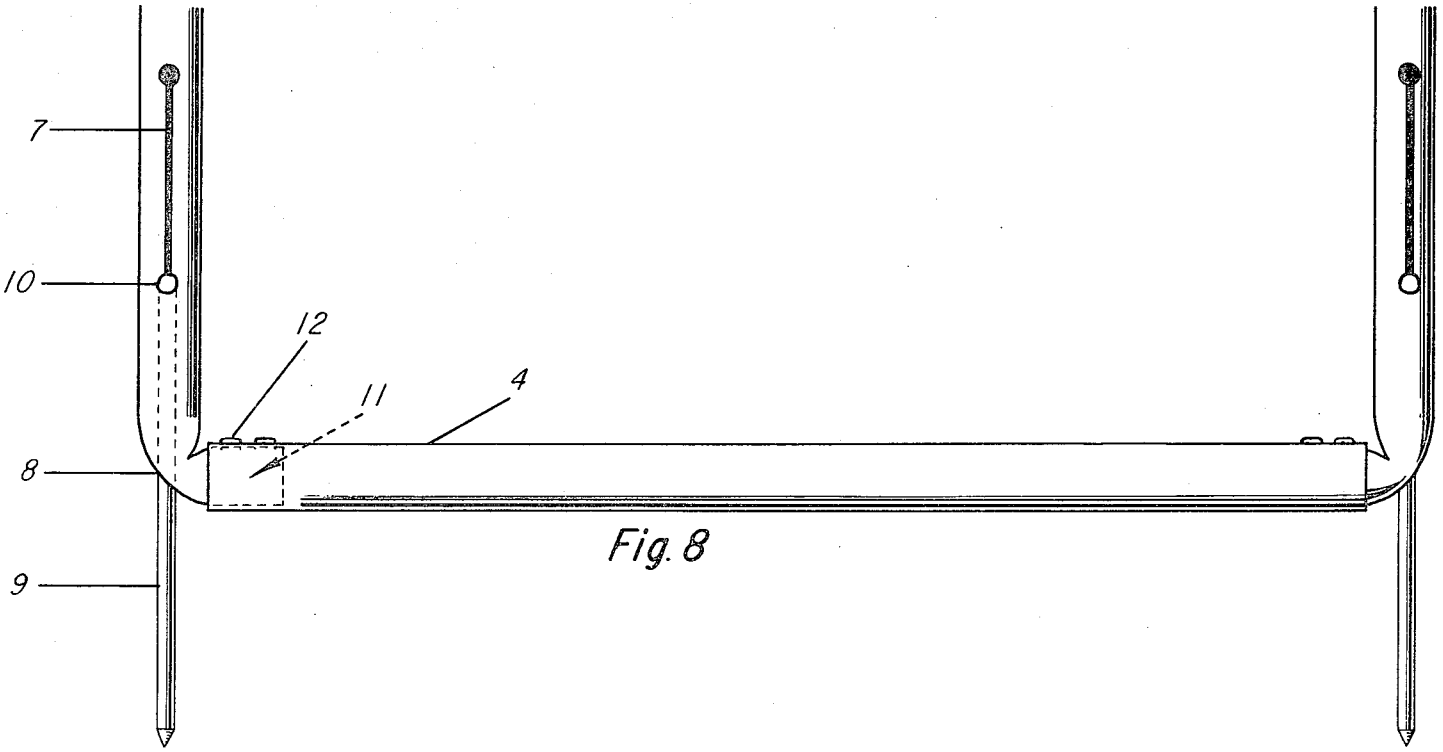
FIG. 8 is a partial view of the device of FIG. 7 showing the spikes in their extended position when the form is adjacent the ground.
Figure 4:
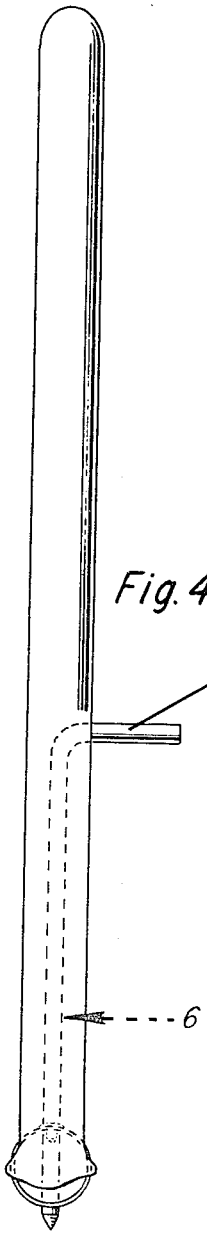
FIG. 4 is an end elevational view of the second embodiment with the spike of FIG. 3 installed.
Figure 6:
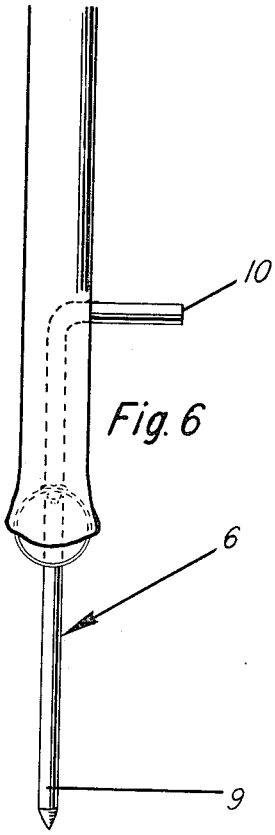
FIG. 6 is a cutaway view similar to FIG. 4, but with the spike of FIGS. 3 and 4 in its extended mode.
Figure 3:
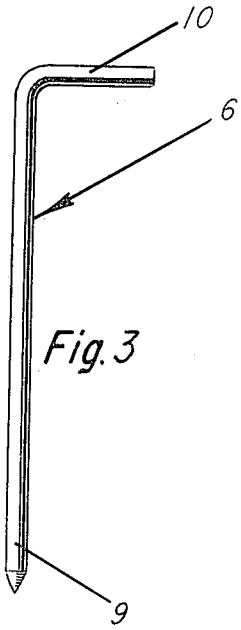
FIG. 3 is an L-shaped spike used with a second embodiment of this invention.
Figure 7:
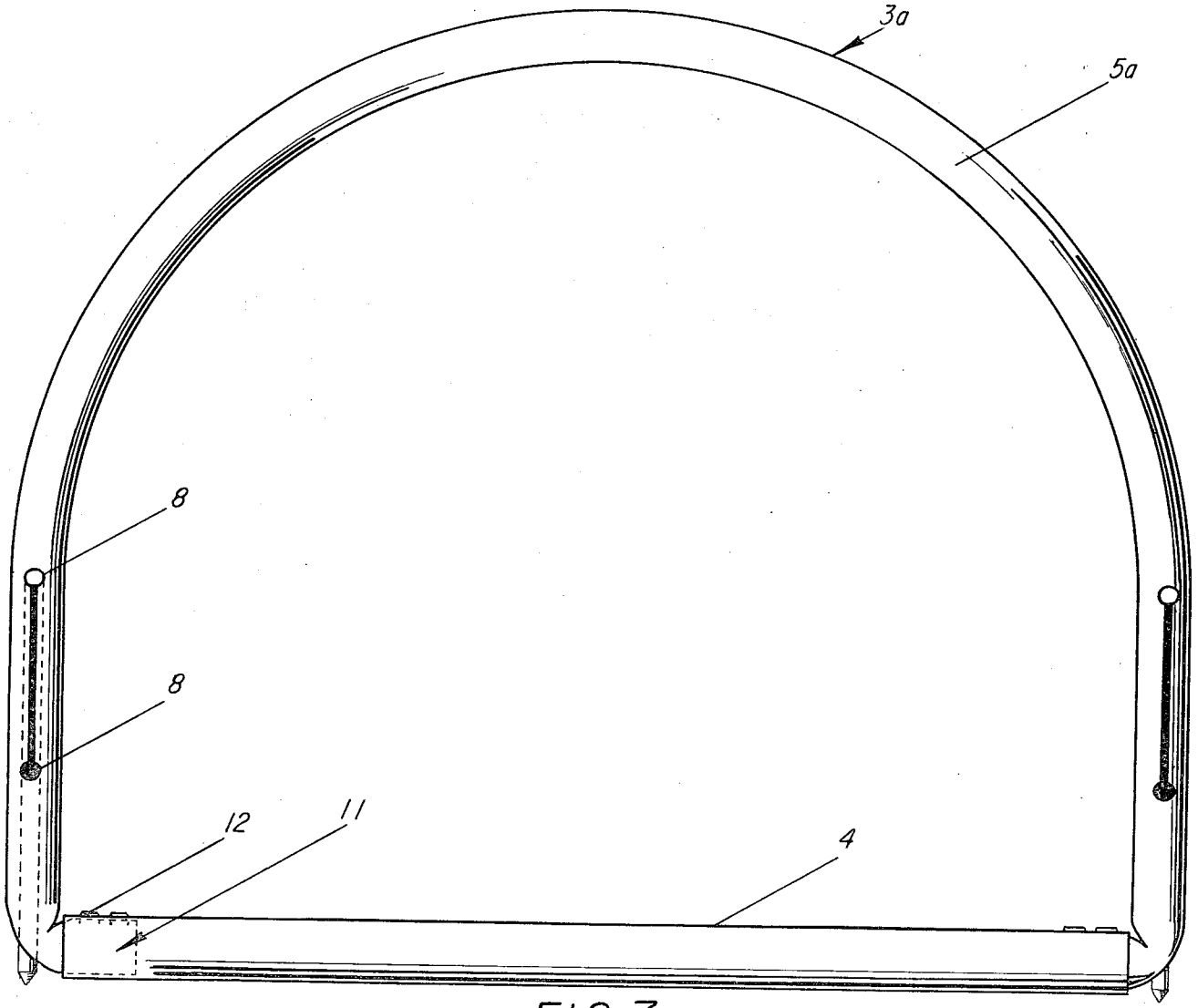
FIG. 7 is a front elevational view of the second embodiment of the grass bag opener form showing the positioning and stabilizing spikes in their retracted position.

Referring now more particularly to the figures of reference on the drawing, it may be explained that the grass bag opener form of the first embodiment shown in FIGS. 1 and 2 is identical to that of the second embodiment shown in FIGS. 7 and 8, with the exception that the latter includes a pair of spaced apart spikes for securement with the ground.

In FIG. 1, the bag unit 1, is comprised of a plastic, or equivalent refuse bag 2, shown held in place around a D-shaped (see FIG. 7) bag opener form 3. When form 3 is apart from the bag 2 and held on a horizontal level with the viewer's eyes, it will appear as shown in FIG. 2, when looking toward the flat bottom 4. The U-shaped portion 5 of the frame 3 is also visible in this view.

As previously noted, the first embodiment 3 is identical with the second embodiment 3A shown in FIGS. 7 and 8, except it contains no spikes 6 or spike slits 7 or openings 8. To convert the form 3 into a form 3A, it is necessary to cut the longitudinal slit 7 for a distance of about six inches and form a hole 8 at each end thereof. Spike 6, being L-shaped, has a long pointed leg 9 and a short leg 10 at right angles thereto which has a blunt end for ease of handling.

The form itself, whether 3 or 3A is made up of a one U-shaped member 5 (without slit 7 and openings 8) or 5A (with slit 7 and openings 8) with its free ends bent at right angles to their former shape (as the straight upper ends of U-shaped member 5, 5A). These bent ends 11 are then inserted into the open ends of the tubing which comprises straight bottom member 4. Brads 12 are inserted into holes (not shown) drilled through both layers of the engaged tubings (4 and 11) to secure the structure together as shown in FIG. 7.

When it is desired to put this invention into use, bag 2 is inserted through the center opening of form 3 (or 3A) as shown in FIG. 9. When a sufficient amount of the bag material adjacent the open end is available to overlap and be stretched around the form 3 or 3A, the bag is folded over the form in the manner shown in FIG. 10 and pulled into stable engagement with the form so that the bag unit 1 may be put into service as shown in FIG. 11. If the form 3A is used in FIGS. 9 and 10, the spikes 6 may be pulled into service as shown in FIG. 12 by grasping the short protruding end 10 and pulling down to expose the pointed end 9 and move the handle 10 from its upper hole 8 to its lower hole 8. At this position, the upper area of the mouth 14 of the bag 2 may be forced over the pointed ends 9 of spikes 6 in moving to the position shown in FIGS. 10 and 13. By grasping handles 10, the spikes 6 may be forced into the earth by reaching under the folded area 14 to directly grip handle 10 between the inner circumference of the fold 14 and the outer circumferenced of the bag 2 at point "P" as shown in FIG. 13.

When filled the bag unit 1 of FIG. 13 may be removed by simply lifting up at the top of form 3A, or the individual spikes 6 may be raised by the handles 10 prior to lifting the form 3A. If spikes 6 are retained in their stowed position until after the bag 2 is loaded onto form 3A, then the insertion of the spike into the ground and the piercing of the ground engaging portion of bag 2 may occur simultaneously.

Whereas the present invention has been described with respect to specific embodiments thereof, it will be understood that various changes and modifications will be suggested to one skilled in the art, and it is intended to encompass such changes and modifications that fall within the scope of the appended claims.

We claim:

1. A refuse bag unit, comprising:

a. a continuous D-shaped form having a central opening about the size of the opening of a refuse bag, b. a refuse bag in said central opening and supported from said form, and c. means on said form to permit a worker to hold said form in an upright manner to expose the opening of said refuse bag adjacent the ground to receive refuse at the ground level, wherein said continuous form includes spike means normally substantially contained within the D-shaped form for permitting said form to stand alone upon insertion of said spike means into the ground when said spike means are activated.

2. A form for holding a refuse bag in place on the ground comprising a D-shaped frame of semi-rigid plastic tubing having a straight lower (an opening) small openings in said straight lower side adjacent the ground and having a U-shaped upper side having a vertical slit therein, and comprising an L-shaped spike in said vertical slit and adapted to be moved through said small openings for penetrating said refuse bag adjacent the opened end thereof and for insertion into the ground through the upper end of said refuse bag in a manner to support said form in a vertical position, and lock said refuse bag between said form and the ground.

3. In a refuse bag holder adapted to receive a thin plastic refuse bag, the combination comprising:

a. D-shaped continuous form of hollow semi-rigid plastic tubing having a straight side for engagement with the ground, small openings in said straight side, and a U-shaped upper side.

b. wherein both sides cooperate to hold the open end of said refuse bag in place and against the ground, c. ground engaging means for locking the refuse bag in place between said straight side and the ground comprising:

d. a guideway in the form of a slit with enlarged holes at each end thereof formed in said semi-rigid tubing, and e. an L-shaped spike normally substantially contained within the holow tubing and in the uppermost hold, and f. said spike adapted for movement from its stowed position in the uppermost hole to its locket position in the lowermost hole with its pointed end passing through said small openings and through the plastic refuse bag to lock said bag and flat side against the ground, g. to provide the open end of said refuse bag in position at ground level to receive refuse, when said spike is forceably pushed through the semi-rigid guideway and through the small opening and through the refuse bag and into the ground.

4. A refuse bag holder assembly as in claim 3 wherein said guideway in said semi-rigid plastic tubing comprises a slit which is normally closed shut but which opens under pressure applied through said spike to act as a guideway when said L-shaped portion of said spike is forceably moved between the uppermost to the lowermost hole adjacent said slit.

* * * * *